US007029404B2

(12) United States Patent
Lu

(10) Patent No.: US 7,029,404 B2
(45) Date of Patent: Apr. 18, 2006

(54) GOLF PUTTER AND PUTTER HEAD

(76) Inventor: Linh Uy Lu, 7503 Milwood Ave., Canoga Park, CA (US) 91303

( * ) Notice: Subject to any disclaimer, the term of this patent is extended or adjusted under 35 U.S.C. 154(b) by 75 days.

(21) Appl. No.: 10/715,614

(22) Filed: Nov. 19, 2003

(65) Prior Publication Data

US 2005/0107185 A1 May 19, 2005

(51) Int. Cl.
*A63B 53/04* (2006.01)

(52) U.S. Cl. ..... 473/334

(58) Field of Classification Search ..... 473/334, 473/336, 324, 288, 256, 337, 349
See application file for complete search history.

(56) References Cited

U.S. PATENT DOCUMENTS 1,902,660 A * 3/1933 Nelson ..... 473/558
3,909,005 A * 9/1975 Piszel ..... 473/248
4,872,684 A * 10/1989 Dippel ..... 473/253
4,881,737 A * 11/1989 Mullins ..... 473/248
4,979,744 A * 12/1990 Alcala ..... 473/341
5,090,698 A * 2/1992 Kleinfelter ..... 473/313
5,447,310 A * 9/1995 Jernigan ..... 473/330
5,501,461 A * 3/1996 Donofrio ..... 473/251
5,571,053 A * 11/1996 Lane ..... 473/336
5,632,694 A * 5/1997 Lee ..... 473/336
5,688,189 A * 11/1997 Bland ..... 473/314
5,938,543 A * 8/1999 McGeeney et al. ..... 473/324
6,450,894 B1 * 9/2002 Sun et al. ..... 473/252
6,511,387 B1 * 1/2003 Grieb ..... 473/330
6,579,193 B1 * 6/2003 McDowell ..... 473/251

* cited by examiner

*Primary Examiner*—Raeann Gorden
(74) *Attorney, Agent, or Firm*—Rapkin, Gitlin & Beaumont

(57) ABSTRACT

An improved golf putter comprising a shaft, a generally resilient tubular or cylinder shaped main body member and a pair of unitary solid weight members each one being releasably attachable to one end of the main body member. The main body member includes end walls at each end thereof and a threaded opening formed within each of the end walls. Each weight member has an outer diameter substantially the same as the exterior diameter of the main body member and a threaded rod integrally formed therewith for threaded engagement with the threaded opening in each of the end walls. The end of each of the weight members that is opposite the end with the threaded rod is usually rounded. The end walls and their corresponding weight members are secured in abutting relation. Generally, the density of the material comprising the weight member is greater than the density of the material comprising the main body member and the combined weight and length of the weight members is greater than the weight and length of the main body member, respectively. The weight members are interchangeable with members having different densities, weights and lengths.

11 Claims, 2 Drawing Sheets

GOLF PUTTER AND PUTTER HEAD

BACKGROUND OF THE INVENTION

1. Field of the Invention

The present invention relates to a golf club and, more particularly, to an improved golf putter having a head with an adjustable and interchangeable system of weights to improve the golf stroke.

2. Description of the Prior Art

Golfers are extremely particular and opinionated when it comes to the selection and use of an appropriate putter. As anyone familiar with the game of golf knows, each stroke counts the same in the scoring. Thus, a 250 yard drive counts the same as a 2 foot putt. More often than not, the "short" or putting game can make the difference between a good or excellent score, and a bad one. Accordingly, a putter with the right balance, "feel" and weight is often critical to scoring well. Most putters on the market have unitary heads, which can differ in weight according to the size and material composition. Few, if any, of these clubs have the capability of interchanging parts to vary the weight and balance and, thus, the "feel" of the club. When they do (see below), the system is so complex and/or involves so many parts that it becomes totally impractical to use the club on the putting green. This is especially so when the need arises to substitute lighter or heavier (or different size) components to change the weight of the club in order to alter the way it feels to the golfer.

Golf putters, including those employing cylindrical heads, are well known in the prior art. Clubs with cylindrical putter heads are disclosed in the following: U.S. Pat. No. 5,433,441, Christopher K. Olsen and Charles Tomasino, Jul. 18, 1995; U.S. Pat. No. 5,390,920, Robert H. Nickum, Feb. 21, 1995; U.S. Pat. No. 6,126,555, Paul T. Schooler, Oct. 3, 2000; U.S. Pat. No. 5,090,698, Thomas A. Kleinfelter, Feb. 25, 1992; Des. 399,546, Lyle D. Polzin, Oct. 13, 2998; and U.S. Pat. No. 3,430,963, John J. Wozniak and Edward J. Jacques, Mar. 4, 1969. Clubs with weighted cylindrical putter heads are disclosed in the following: U.S. Pat. No. 6,524,193B1, Wallace E. Devore, Feb. 25, 2003; U.S. Pat. No. 5,632,694, Doo-Pyung Lee, May 27, 1997; U.S. Pat. No. 6,511,387, B2, LaRue O. Grieb, Jan. 28, 2003; U.S. Pat. No. 4,222,566, Troy R. Berry, Sep. 16, 1980; U.S. Pat. No. 6,579,193,B1, Michael G. McDowell, Jun. 17, 2003; and, U.S. Pat. No. 3,909,005, Geza A. Piszel, Sep. 30, 1975.

None of the devices disclosed in the prior art teaches a putter head with a main body member and easily interchangeable weighted members releasably engaged to the main body member at opposite ends thereof, as claimed by the present invention.

Therefore, there is a need for the golf putter of the present invention to address and resolve the differences among the devices of the prior art.

SUMMARY OF THE INVENTION

In its preferred embodiment, the present invention provides an improved golf putter comprising a shaft, a generally resilient tubular or cylinder shaped main body member and a pair of unitary solid weight members each one being releasably attachable to one end of the main body member. The main body member includes end walls at each end thereof and a threaded opening formed within each of the end walls. Each weight member has an outer diameter substantially the same as the exterior diameter of the main body member and a threaded rod integrally formed therewith for threaded engagement with the threaded opening in each of the end walls. The end of each of the weight members that is opposite the end with the threaded rod is usually rounded. The end walls and their corresponding weight members are secured in abutting relation to secure the components as an integral unit and enhance the communication between the ball at impact and the golfer's hands holding the shaft. Generally, the density of the material comprising the weight member is greater than the density of the material comprising the main body member, though the weight member material density could be less. The combined weight and length of the weight members are generally greater than the weight and length of the main body member, respectively, though here, as well, the combined weight and length could also be less. The weight members are interchangeable with members having different densities, weights and lengths.

Accordingly, it is an object of the present invention to provide an improved head of a golf putter that includes a tubular shaped main body member with a weight member releasably attachable at each end thereof.

It is also an object of the present invention to provide an improved head of a golf putter that includes a tubular shaped main body member with a weight member attached to each end having an outside diameter substantially the same as the exterior diameter of the tubular shaped main body member.

It is yet another object of the present invention to provide an improved head of a golf putter that includes a tubular shaped main body member having end walls with threaded openings formed therein.

It is yet another object of the present invention to provide an improved head of a golf putter with weight members that are individually more dense and, in combination, heavier than the tubular shaped main body member.

It is yet another object of the present invention to provide an improved head of a golf putter that includes weight members that are interchangeable with weight members having different densities, weights and lengths.

It is yet another object of the present invention to provide an improved head of a golf putter with a resilient main body member and weight members that are densely compact and hard.

It is yet another object of the present invention to provide an improved head of a golf putter that enhances the communication between the ball at impact and the golfer's hands holding the shaft.

It is yet another object of the present invention to provide an improved head of a golf putter that is easy to use and cost effective to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
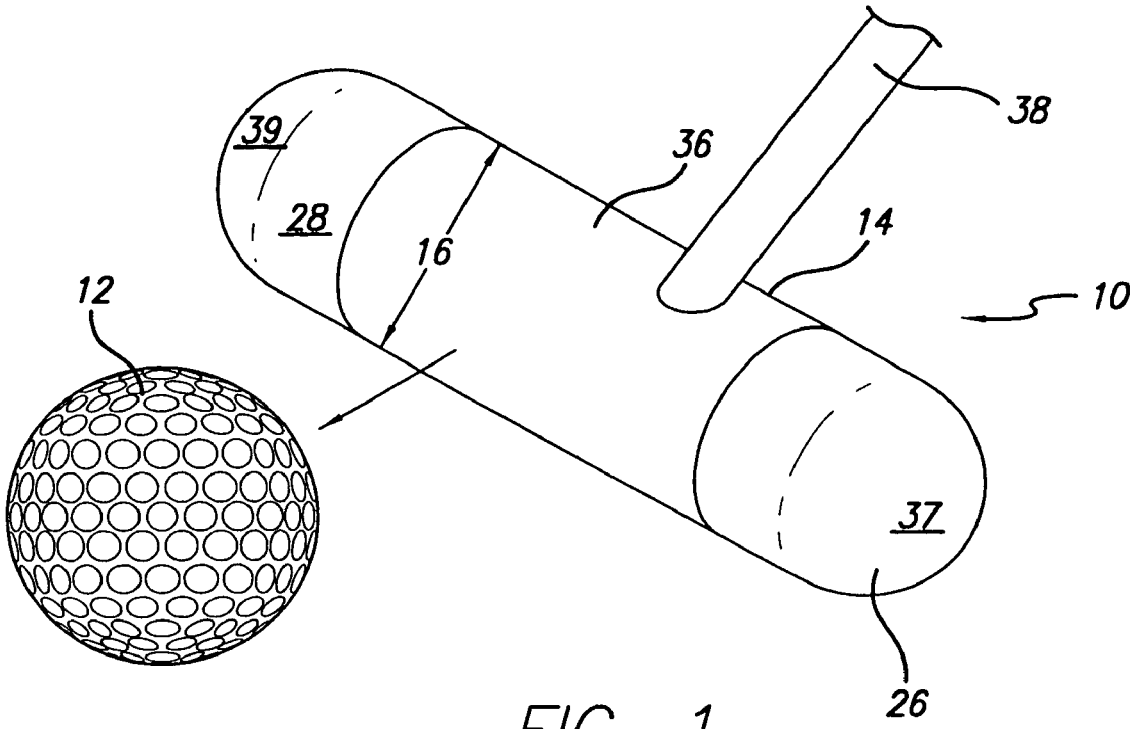
FIG. 1 is a perspective view of the golf putter head of the present invention shown striking a golf ball.
Figure 2:
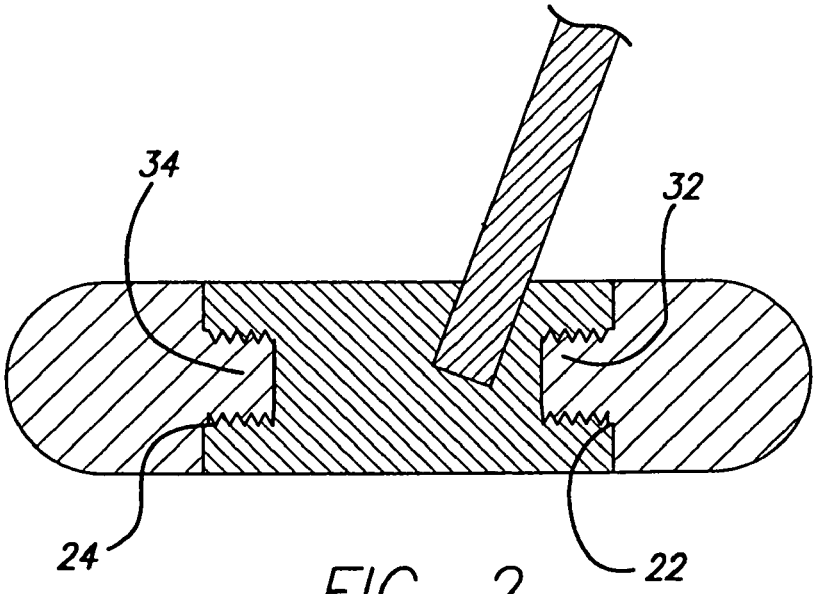
FIG. 2 is a sectional view of the golf putter head of the present invention.
Figure 3:
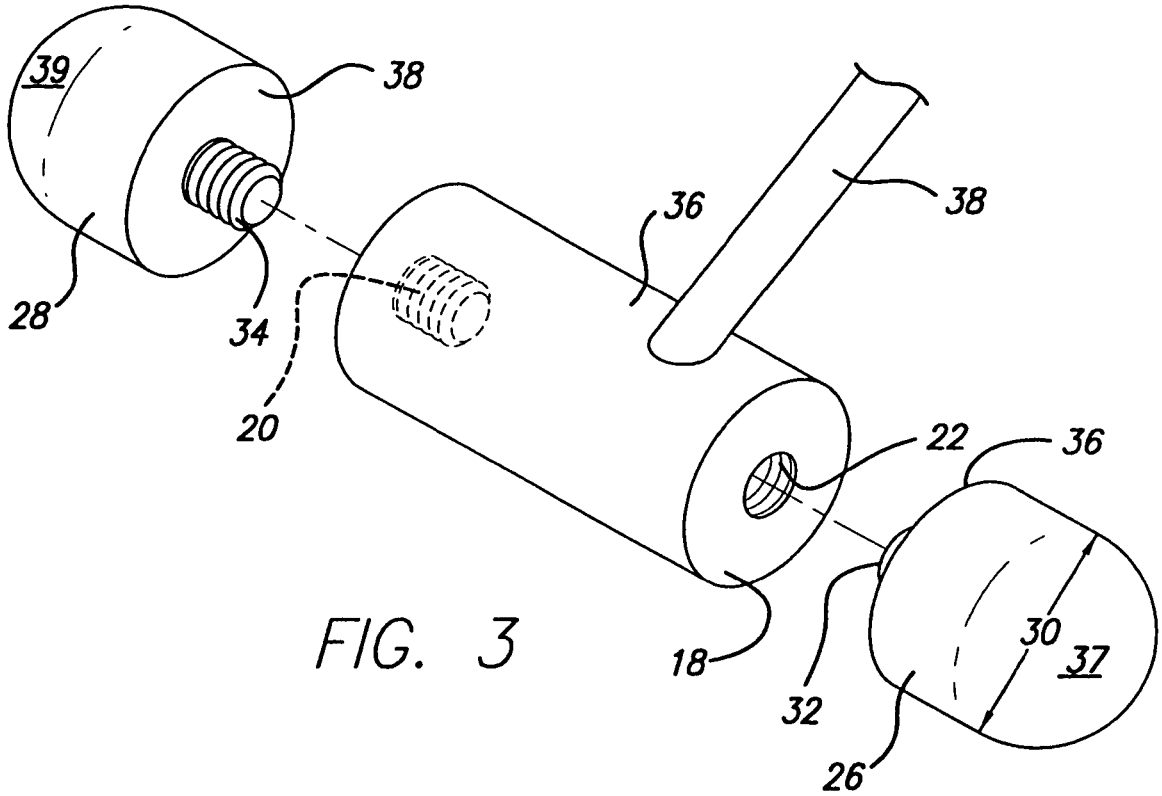
FIG. 3 is an exploded perspective view of the golf putter head in accordance with the preferred embodiment of the present invention.

Referring more particularly to the drawings, FIG. 1 is a perspective view of the putter club head 10 in accordance with the present invention shown in the act of striking golf ball 12. Head 10 includes a tubular shaped main body member 14 having an exterior diameter 16 and end walls 18 and 20 at each end of the main body member 14. Threaded openings 22 and 24 are formed within end walls 18 and 20, respectively. Head 10 also includes generally tubular shaped weight members 26 and 28, which are commonly comprised of a unitary solid material, such as steel or some other metal or metal alloy suitable in weight and density. The outer diameter 30 of weight members 26 and 28 is generally the same as the exterior diameter 16 of main body member 14. Threaded rods 32 and 34 are integrally formed at ends 36 and 38 of weight members 26 and 28, respectively. Threaded rods 32 and 34 are provided for threaded engagement with their corresponding threaded openings 22 and 24 for releasably securing weight members 26 and 28 to main body member 14 in abutting relation. Other means of attachment may also be suitable. Ends 37 and 39 of weight members 26 and 28, respectively, are typically rounded, though other shapes may be incorporated as desired.

Main body member 14 may be comprised of any suitable resilient material, typically synthetic, that offers some degree of flexibility or "bounce" when body member 14 strikes golf ball 12. The length of weight members 26 and 28 may vary. In some instances the weights of members 26 and 28, either individually or in combination, might be less than, the same as or even exceed the weight of main body member 14 depending upon a variety of factors, including, without limitation, the demands or needs of the individual golfer, the conditions of the putting green, the weather, etc. Thus, the ability to interchange weight members 26 and 28 with weights that vary in density, weight and/or length becomes of paramount importance.

Attached to the upper surface 36 of main body member 14 is shaft 38 of any suitable material and design.

Figure 4:
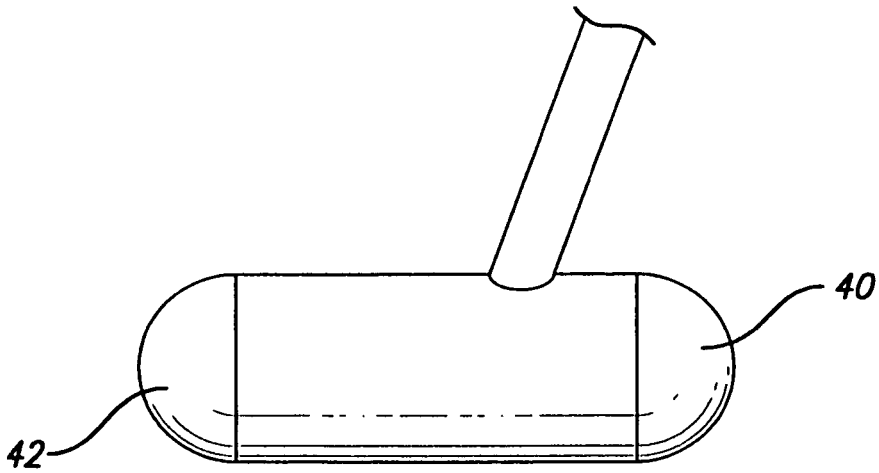
FIG. 4 is an elevational view of the golf putter head in accordance with an alternate embodiment of the present invention.

FIG. 4 is an elevational view of an alternative embodiment of a putter club head in accordance with the present invention. Here, weight members 40 and 42 are shorter in length than their counterparts shown elsewhere in the drawings.

In the application of the present invention, head 10 will typically include a single main body member 14 to which are attached any combination of weight members 26 and 28 (or 40 and 42) depending on how heavy or light a particular golfer may desire the club to be to accommodate the conditions and reach maximum effectiveness on the putting green (not shown). It is also possible that the needs of the golfer might desire an uneven or unbalanced weighting on the ends of the main body member 14, and this is easily accomplished by interchanging the weight members with appropriate substitutes.

Other possible configurations for putter club head 10 include, without limitation, a generally rectangular shaped head with rounded edges and ends or simply an elongated rectangular shaped head with squared off edges and ends.

Head 10, as constructed in accordance with the present invention, greatly enhances the communication between the ball at impact and the golfer's hands holding the club shaft. This is essential to a successful golf score.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A golf putter comprising:

a shaft, a head comprising a generally tubular shaped main body member possessing a certain density, said main body member having an exterior diameter and an end wall at each end of said main body member and a threaded opening formed within each said end wall, and a pair of generally tubular shaped weight members comprised of a unitary solid material, each of said weight members having an outer diameter substantially the same as the exterior diameter of said tubular shaped main body member and a threaded rod integrally formed at one end thereof for threaded engagement with said threaded opening for releasably securing each said weight member to said main body member in abutting relation, and each said weight member having a density greater than the density of said main body member.

2. The golf putter of claim 1 wherein the end of said weight member opposite the end with said threaded rod is rounded.

3. The golf putter of claim 1 wherein the combined weight of said weight members is greater than the weight of said main body member.

4. The golf putter of claim 1 wherein the weight of one of said weight members is greater than the weight of said main body member.

5. The golf putter of claim 1 wherein the length of said main body member is greater than the length of one of said weight members.

6. The golf putter of claim 1 wherein the length of said main body member is greater than the combined length of said weight members.

7. The golf putter of claim 1 wherein said weight member is interchangeable with a weight member having a different weight or density.

8. The golf putter of claim 1 wherein said weight member is interchangeable with a weight member having a different length.

9. The golf putter of claim 1 wherein said main body member is comprised of a resilient material.

10. The golf putter of claim 1 wherein said weight members are comprised of metal or a metal alloy.

11. The golf putter of claim 1 wherein said shaft is attached to said main body member.

* * * * *